US010900211B1

(12) United States Patent
Lei

(10) Patent No.: US 10,900,211 B1
(45) Date of Patent: Jan. 26, 2021

(54) APPARATUS TO SCRAPE AND EXTRACT DRAIN CLOG DEBRIS

(71) Applicant: Skip A Lei, Portland, OR (US)

(72) Inventor: Skip A Lei, Portland, OR (US)

( * ) Notice: Subject to any disclaimer, the term of this patent is extended or adjusted under 35 U.S.C. 154(b) by 0 days.

(21) Appl. No.: 16/552,094

(22) Filed: Aug. 27, 2019

(51) Int. Cl.

| | |
|---|---|
| ***E03C 1/302*** | (2006.01) |
| ***B08B 9/027*** | (2006.01) |
| ***B08B 9/045*** | (2006.01) |
| ***E03F 9/00*** | (2006.01) |

(52) U.S. Cl.
CPC ..... *E03C 1/302* (2013.01); *B08B 9/045* (2013.01); *E03F 9/005* (2013.01); *B08B 9/027* (2013.01); *B08B 2209/04* (2013.01)

(58) Field of Classification Search
CPC ..... E03C 1/302; B08B 9/0436; B08B 9/027; B08B 9/045
See application file for complete search history.

(56) References Cited

U.S. PATENT DOCUMENTS

| | | | | |
|---|---|---|---|---|
| 6,775,873 | B2 * | 8/2004 | Luoma | E03C 1/302 15/104.001 |
| D639,623 | S * | 6/2011 | Tash | D8/14 |
| 10,786,268 | B2 * | 9/2020 | Ben-Ami | A61B 17/22031 |
| 2003/0056810 | A1 * | 3/2003 | Petit | E03C 1/302 134/8 |
| 2014/0190516 | A1 * | 7/2014 | Petry | E03C 1/302 134/8 |
| 2016/0221050 | A1 * | 8/2016 | Beck | B25G 1/04 |
| 2019/0376271 | A1 * | 12/2019 | Null | E03C 1/302 |

* cited by examiner

*Primary Examiner* — Michael D Jennings
(74) *Attorney, Agent, or Firm* — Sean Fitzgerald

(57) ABSTRACT

An apparatus for removing a clog from a drain consists of an elongated, flexible shaft member with a corkscrew or coil member with an integrated handle at one end and a scraper element at the other end. Inserting the scraper element end into a clogged drain and manually turning the handle allows the scraper element to scrape the materials causing the clog to be scraped from the inside of the drain while the corkscrew portion of the apparatus worms through the matter that is clogging the drain, and when the apparatus is pulled from the drain the clogging matter is held within the corkscrew member to capture the clogging matter or debris for easy removal.

8 Claims, 3 Drawing Sheets

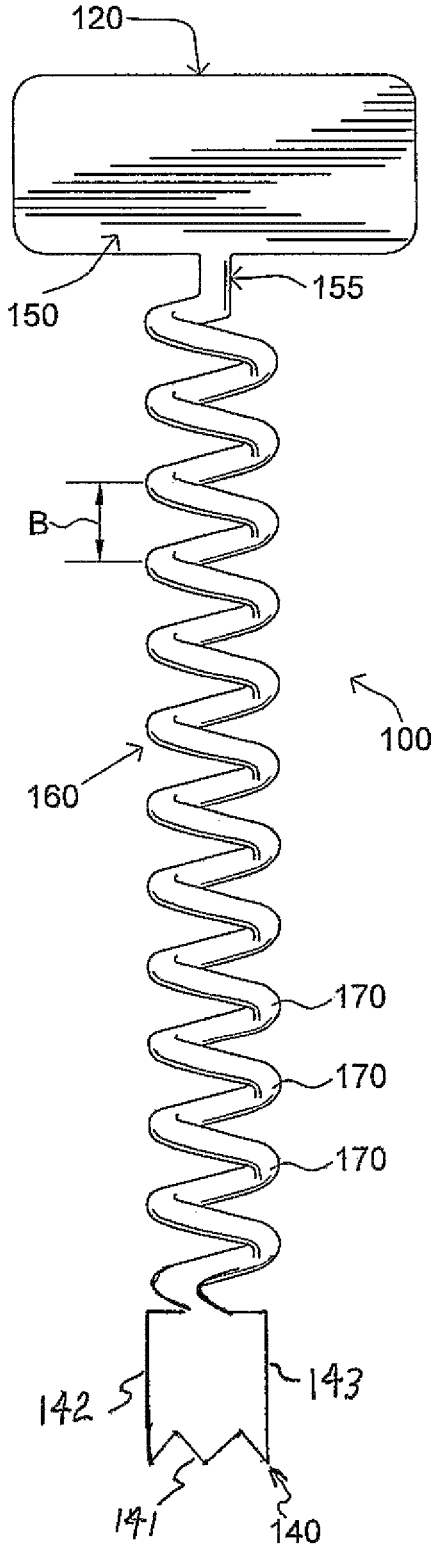
FIG. 1A
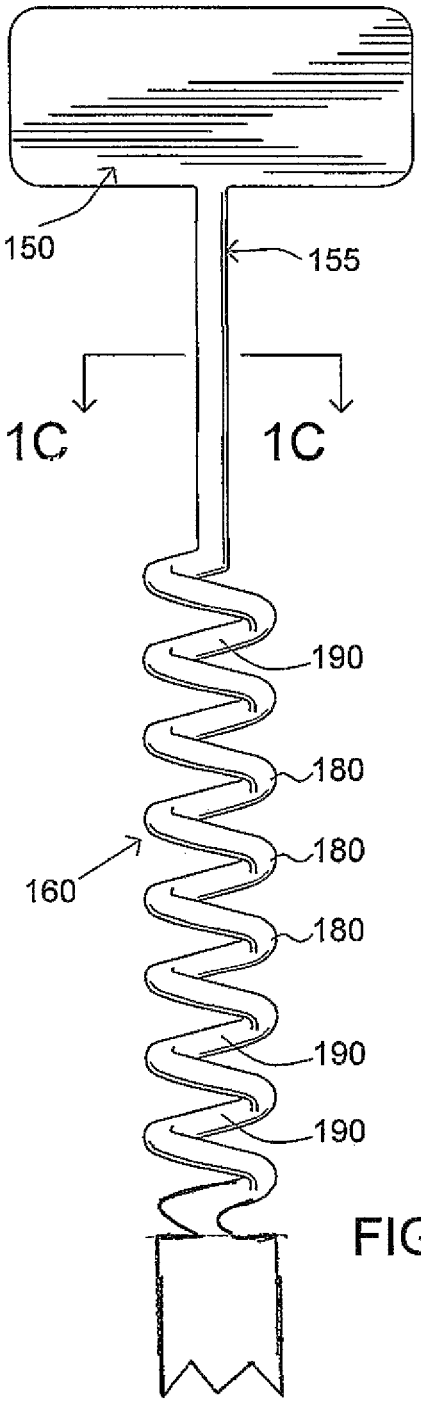
FIG. 1B
FIG. 1C

APPARATUS TO SCRAPE AND EXTRACT DRAIN CLOG DEBRIS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

This invention generally relates to a low cost, single use, disposable device for scraping the inside of a drain and clearing a clog from a drain, and more particularly, for scraping the inside of a drain and clearing a clog from a bathroom sink, shower, or bathtub drain.

Simple drain clogs have been a problem ever since the creation of plumbing. Bathroom sinks, showers and tubs tend to be subject to clogs from hair and soap. Bathroom sinks in addition have toothpaste, shaving creams, hair jells as, well as other substances that people use in the bathroom. Whatever the substance, the substances tend, over time to attach, ball up, and form clogs of "gunk" that slow, narrow the internal diameter of the drain and eventually stop up the drain.

Consumers have had several paths to alleviate the problem of clogs by calling a plumber, or with cost in mind, turning to self help. One self help approach to remove clogs is by adding a chemical (liquid or dry) into the clogged drain. The chemicals react with clog, and then are flushed with water to clear the clog and chemicals. A drawback of chemicals is that they are generally caustic to the drain, and they can be deadly to the user as well as the environment. And if not deadly, chemicals can get in the eyes of a user and potentially cause serious harm. For these reasons, chemicals should be avoided.

A second option is to run a "snake" down the drain in order to penetrate the clog, break up the mass, and again, with, water, flush the clog further down the drain. Large snake devices are expensive, and if not used correctly, can push the material causing a clog to move further down the drain.

Other attempts to provide an inexpensive option to clean clogs from hair in drains are known. For example, U.S. Pat. No. 6,775,873 (Luoma) discloses an elongated, flexible shaft with a plurality of barbed portions interspersed along its length. While this is an advantage over another device disclosed in U.S. Pat. No. 5,836,032 (Hondo), which consists of an elongated shaft with a plurality of hook members located only at the end of the shaft for picking up hair from within the drain, the Luoma device has its own disadvantages.

First, the Luoma device only grabs hair and gunk with the small hook members. It does nothing to remove the build up of gunk on the inside of the drain wall.

Second, the Luoma device, having the barbed portions interspersed along its length, present sharp edges that pose a risk to the user who could be cut or poked by the barbed portions along the length of the device.

The present invention, "The Pigtail Scraper," is an improvement on Applicants U.S. Patent Application 20150176263 which was created to be a simple to use, low cost method to attack minor clogs. The improvement which is the basis of the clamed invention is the scraper element built into the device to scrape the interior walls of the drain. This combination with the pigtail element provides a better device for clearing clogged drains.

To use the Pigtail Scraper it is first inserted into the drain and then, just by continuously twisting the top, or handle, the scraper element portion presents a front portion and side portions to make contact with the clog. The pigtail portion (with or without micro barbs) would secure hair and other matter clogging the drain (such as shampoo, conditioner, toothpaste). The twisting motion of the Pigtail Scraper corkscrewing, or worming its way through a clog would allow the scraper front and sides to scrape gunk off of the interior walls of the drain while the clog is grasped by the pigtail portion to make the scrapped and gathered debris to "climb" the pigtail portion of the Pigtail Scraper and then make it easier to pull up and extract the clog, rather than push it down the drain.

The Pigtail Scraper does NOT dissolve the clog. It break it apart, then it collects, gathers, and extracts hair and debris up and out of the drain itself at the same time the novel scraper removes collected matter from the inner lining of the drain.

As the Pigtail Scraper would likely be made of an injected plastic to hold down costs; it would be considered "one use only" and, disposable. This innovation could certainly be made from metal as well, with the intent to use over and over again, but that would require cleaning and thus is not preferred. However, to be most appealing to consumers, it would be a single use, disposable article of manufacture that is constructed from a semi-rigid plastic chosen to be flexible enough to bend at any bend in a drain, yet rigid enough to hold the clog matter within the coils of the Pigtail Scraper.

The Pigtail Scraper would be the easy to use, easy to dispose, non-chemical solution to extracting simple household drain clogs.

BRIEF SUMMARY OF THE INVENTION

The present invention is preferably a single injected part that is made from a material that can flex, however, at the same time retain the integrity of its shape during use. This device is called a "Pigtail Scraper" as it would have a pigtail or corkscrew shape portion that would offer flexibility to the device as it is maneuvered in and out of a clogged drain. It would have a square or oval shape at the top to use as both a "holder" and a "twister" but any shape that is large enough to allow a thumb and index finger to grasp and turn the Pigtail Scraper will be sufficient to be a handle. Preferably, the present invention would be of a cylinder shaped elongated shaft wound helically about an axis to form a coil like a spring, having a scraper element at a lower, distal end for initial insertion into a drain and having a handle at the upper, or proximal end to aid in rotation of the pigtail. The coil, or pigtail, would, preferably, for a bathroom sink sized drain, have an outer diameter about the width of a number 2 pencil, or about 7 mm so as to be easily inserted and removed from a drain entry. This outer diameter of the worm could be larger for clogs in larger drains. Alternatively the present invention could be formed of a flexible member formed in a rectangular cross section rather than cylindrical. With the rectangular cross section, it would still be wound helically about an axis to form a coil. This shape could be chosen for ease of manufacture, or resiliency and, strength.

Overall, the length of the present invention, the Pigtail Scraper, can be short or long depending on the specific type of drain the user is seeking to clear, but generally the preferred length of the present invention is between 18 and 36 inches. The coils can have coils of uniform diameter and spacing (the pitch of the coils), or the coils can have different diameters and or different pitch (the space between adjacent turns of the coil).

The present invention could have micro barbs on the outside facing surface of the coils to better grab hair and free debris that may be causing the clog, while the inside surface of the coils is free of barbs to allow the clog matter to be drawn up within the coils.

Most importantly, the present invention will have a scraper element at the end to be inserted into the drain. This scraper element could be in the shape of a rounded shovel head or a square shovel head as long as the width of the scraper element is no less than the diameter of the coils so that the edges of the scraper element can make contact with the interior wall of the drain in which it has be inserted.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE SEVERAL VIEWS OF THE DRAWING

FIG. 1A is a plan view showing one embodiment of the device in accordance with this invention;

FIG. 1B is a plan view showing another embodiment of the device in accordance with this invention;

FIG. 1C is a schematic sectional view taken along, line 1C-1C of FIG. 1B showing one embodiment of the device;

DETAILED DESCRIPTION OF THE INVENTION

Figure 2:
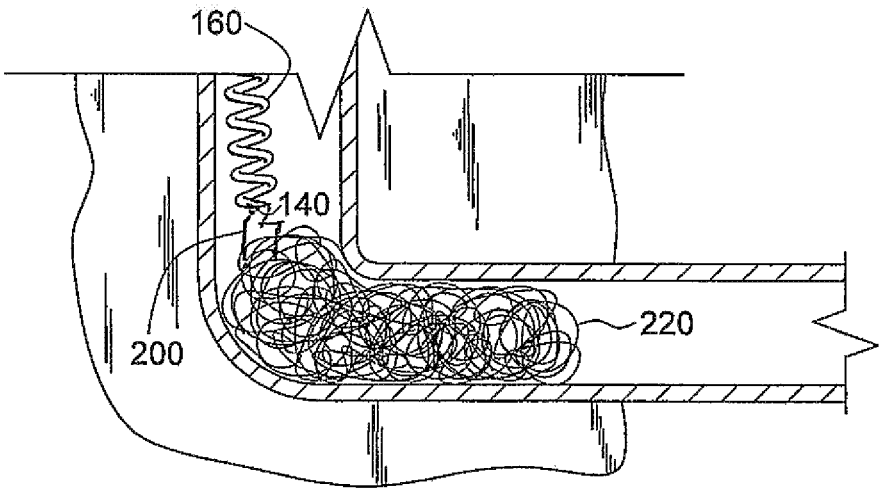
FIG. 2 is a cross section of a drain view showing the device in accordance with this invention being, inserted into a drain with the distal end approaching a clog.

Referring now to the drawings, in particular FIG. 1A and FIG. 1B, the apparatus of the present invention is generally shown in the Figures as reference numeral 100.

Figure 3:
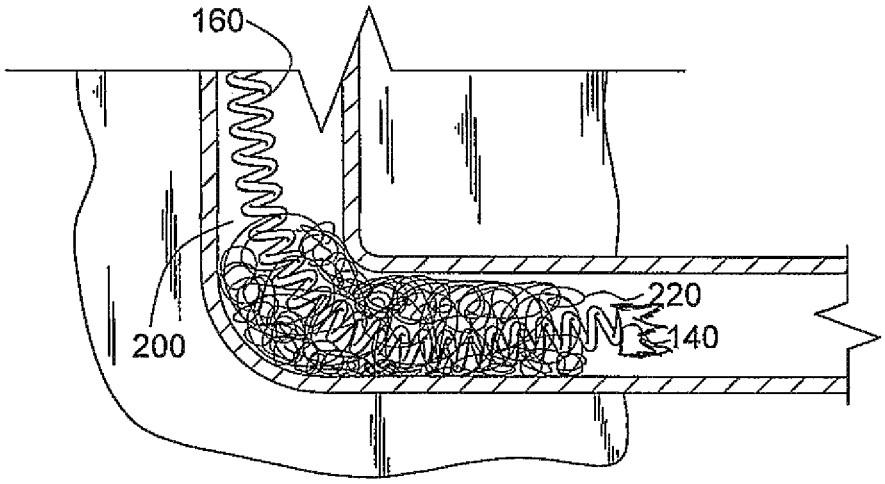
FIG. 3 is a cross section of a drain view showing the device in accordance with this invention with the distal end having wormed or corkscrewed through the a clog.

The apparatus 100 has a proximal end 120 and a distal end 140, and consists of a handle 150 with an extended or elongated shaft 155 formed into a coil 160. Preferably, the shaft and, coil 160 is substantially of a cylindrical cross section as shown in FIG. 1C, where the shaft 155 is wound helically about an axis to form the coil 160 or "worm", a scraper element at the lower, distal end 140 for initial insertion into a drain (as shown in FIGS. 2 and 3), although the distal end 140 could be blunt, in the preferred embodiment the distal end side of the scraper element is formed in a sawtooth pattern of at least 2 teeth.

Figure 5:
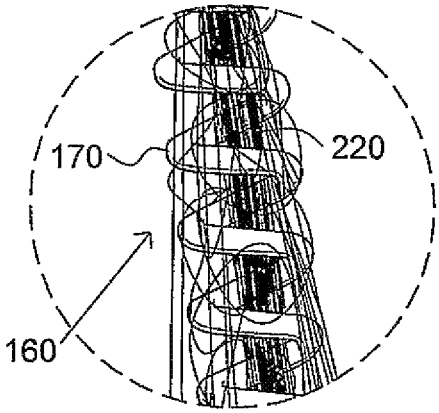
FIG. 5 is a close up view of area 5 of FIG. 4 showing the removal of a clog from a drain.

The handle 150 at the upper, or proximal end 120, can be of any shape and size provided it can be gripped and turned (as shown in FIG. 5) to aid in rotation of the device 100.

Looking at FIG. 1A, elongated shaft 155 can be wound into the coil 160 substantially all the way from distal end 140 (the scraper element) to the handle 150, or as shown in FIG. 1B, the preferred embodiment, the coil 160 may be formed only partially along the elongated shaft to leave more shaft extending from the handle.

As best seen in FIG. 1A, the individual turns or coils 170 can be uniform in size (diameter) and spacing (shown as "B" on FIG. 1A), but (not shown), individual turns or coils may be of a different size and spacing, with some coils having tighter spacing than other coils.

Coils 170 have as shown in FIG. 1B, an outer surface 180, and an inner surface 190. The outer surface 180 can be a clean surface, or the outer surface can have micro barbs formed on at least part of coil 160. These micro barbs can be of any shape that will hold onto clog matter in a drain, but are small enough in size with blunt or rounded ends so as not to be sharp or to present a safety hazard to a user. Inner surface 190 is preferably a clean surface, as smooth as possible to allow the clog matter to climb up the coil 160.

Operation of the device 100 is shown in FIGS. 2, 3, 4, and 5. A person grips the device 100 by its handle 150. As show in FIGS. 2 and 3, the device 100 is then inserted into the drain 200, with the distal end 140 moving toward a clog 220.

FIG. 3 shows the device 100 fully inserted into the drain 200, with coil 160 passing through clog 220. Rather than being pushed through clog 220, the coil 160 is wormed, or corkscrewed through clog 220 by a person turning handle 150. The turning motion of the device 100 causes the scraping edges (see FIG. 1A, 141, 142, and 143) of the scraping element to at times engage the inner wall of the drain as the device 100 is rotated. Contact with the rotating scraper element will scrape the clog materials off of the inner wall of the drain thereby producing a cleaner drain than was possible with prior tools and methods. Then the clog 220 will "climb" the coil 160 due to the rotation of the device 100 which makes it easier to pull up and extract the clog 220.

Figure 4:
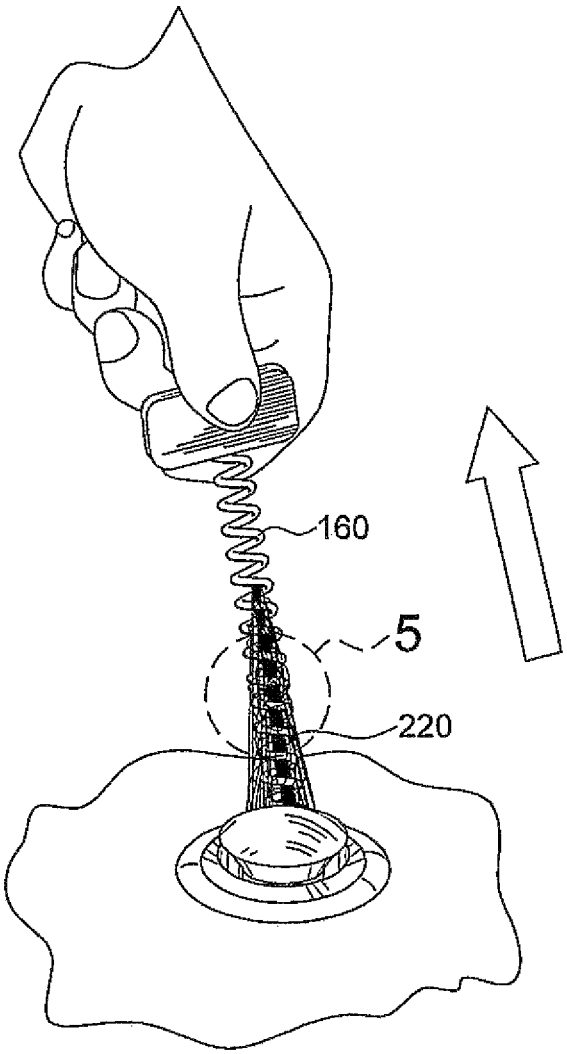
FIG. 4 is a schematic perspective view of the drain cleaning device in, accordance with this invention shown in the removal of a clog from a drain.

As shown in FIG. 4, the device 100 is then withdrawn from the drain 200 in the direction as shown by the arrow in FIG. 4, with the clog 220 being removed from the drain. As more clearly show in FIG. 5, a close up of area 5 shown in FIG. 4, the clog 220 is substantially pulled up into and held within individual coils 170 of coil 160 by the corkscrew motion of a user turning handle 150.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed as new and desired to be protected by Letters Patent is set forth in the appended claims.

What is claimed is:

1. Apparatus for scraping the interior of a drain and removing a clog from a drain, comprising:

(a) an elongated flexible shaft;

(b) the elongated flexible shaft having a coil portion and a scraper element at a distal end, said scraper element having at least one scraper edge to engage an inner wall of said drain;

(c) a handle, wherein the handle is integrated to the flexible shaft at the end of the flexible shaft opposite the scraper element end of the shaft, whereby a turning of said handle causes said scraper edge to engage said inner wall of said drain and scrape gunk from said inner wall of said drain; and (d) wherein said scraper element has said scraper edge on a first side of said distal end and a second scraper edge on an opposite side of said distal end.

2. The apparatus of claim 1, wherein said scraper element has a distal end formed in a sawtooth pattern of at least two teeth.

3. The apparatus of claim 1, wherein the coil portion extends from the scraper element end of the flexible shaft to the handle portion.

4. The apparatus of claim 1, wherein said scraper element is integrally molded as an end of said elongate, flexible shaft and said scraper element is formed in a shape of a shovel head with a width at least as great as a diameter of said.

5. Apparatus for scraping an inner wall of a drain, comprising:

(a) an elongated, flexible shaft having a proximal end and a distal end;

(b) the elongated, flexible shaft having a portion at least partially formed as a coil;

(c) a handle integrally molded as the proximal end of the elongate, flexible shaft; and (d) a scraper element integrally molded at the end of the flexible shaft opposite the handle, said scraper element being formed in the shape of a shovel having a width at least as great as a diameter of said coil.

6. The apparatus of claim 5, wherein the scraper element has a straight scraper edge on either side of said scraper element each of said scraper edges being designed to engage said inner wall of said drain to remove gunk from said inner wall when said handle is turned while said scraper element is inside of said drain.

7. The apparatus of claim 6, wherein the scraper element has a distil end scraper element formed in a sawtooth pattern with at least two teeth.

8. The apparatus of claim 7, wherein the scraper element is formed of an injected plastic.

* * * * *